US007942655B2

(12) United States Patent
Shaffer

(10) Patent No.: US 7,942,655 B2
(45) Date of Patent: May 17, 2011

(54) ADVANCED SCROLL COMPRESSOR, VACUUM PUMP, AND EXPANDER

(75) Inventor: Robert W. Shaffer, Broomfield, CO (US)

(73) Assignee: Air Squared, Inc., Broomfield, CO (US)

( * ) Notice: Subject to any disclaimer, the term of this patent is extended or adjusted under 35 U.S.C. 154(b) by 910 days.

(21) Appl. No.: 11/703,585

(22) Filed: Feb. 6, 2007

(65) Prior Publication Data

US 2007/0189912 A1 Aug. 16, 2007

Related U.S. Application Data

(60) Provisional application No. 60/773,274, filed on Feb. 14, 2006.

(51) Int. Cl.
*F01C 1/02* (2006.01)

(52) U.S. Cl. ..... 418/55.1; 418/55.2

(58) Field of Classification Search ..... 418/55.1–55.6
See application file for complete search history.

(56) References Cited

U.S. PATENT DOCUMENTS 3,802,809 A * 4/1974 Vulliez ..... 418/5
3,986,799 A * 10/1976 McCullough ..... 418/55.2
3,994,636 A * 11/1976 McCullough et al. ..... 418/55.4
4,340,339 A * 7/1982 Hiraga et al. ..... 418/55.6
4,415,317 A * 11/1983 Butterworth ..... 418/55.1
4,416,597 A * 11/1983 Eber et al. ..... 277/379
4,462,771 A * 7/1984 Teegarden ..... 277/379
4,718,836 A * 1/1988 Pottier et al. ..... 417/205
4,730,375 A * 3/1988 Nakamura et al. ..... 29/888.022
4,892,469 A * 1/1990 McCullough et al. ..... 418/55.5
5,160,253 A * 11/1992 Okada et al. ..... 418/55.2
5,466,134 A 11/1995 Shaffer et al.
5,632,612 A 5/1997 Shaffer
5,752,816 A 5/1998 Shaffer
5,759,020 A 6/1998 Shaffer
5,951,268 A * 9/1999 Pottier et al. ..... 418/5
6,050,792 A 4/2000 Shaffer
6,129,530 A 10/2000 Shaffer
6,379,134 B2 * 4/2002 Iizuka ..... 418/55.2
6,439,864 B1 8/2002 Shaffer
6,511,308 B2 1/2003 Shaffer

* cited by examiner

*Primary Examiner* — Thomas Denion
*Assistant Examiner* — Douglas J. Duff
(74) *Attorney, Agent, or Firm* — Paul M. Denk

(57) ABSTRACT

Modifications of a scroll compressor provide a bellows suitable for liquid cooling and a plunger actuated seal for the scroll tips of various equipment. A bellows spans the fixed and the orbiting scrolls and hermetically seals the scroll device. Using two bellows, the present invention allows for liquid cooling of a compressor with an inlet and an outlet to exhaust heated coolant to a heat exchanger. Then the scrolls have a spiral upon a plate that ends in a tip. A seal upon the tip that abuts the fixed scroll upon a biased plunger modifies existing scroll designs to maintain the seal in contact with the fixed scroll. The modifications also provide an improved coating that seals the fixed and orbiting scrolls to each other without the use of epoxy, disassembly, and cleaning.

5 Claims, 5 Drawing Sheets

ADVANCED SCROLL COMPRESSOR, VACUUM PUMP, AND EXPANDER

CROSS REFERENCE TO RELATED APPLICATION

This nonprovisional patent application claims priority to the provisional patent application having Ser. No. 60/773,274, which was filed on Feb. 14, 2006. The provisional application was filed during the pendency of PCT application Ser. No. PCT/US01/50377 which was filed on Dec. 31, 2001 designating the U.S., and which claimed priority to the U.S. non-provisional application Ser. No. 09/751,057 which was filed on Jan. 2, 2001 and is now U.S. Pat. No. 6,511,308.

BACKGROUND OF THE INVENTION

The modifications to scroll compressors relate generally to scroll compressors, expanders, and vacuum pumps that alter or reduce the pressure of gases within a container. More specifically, these modifications refer to bellows design, liquid cooling of a compressor, and tip seal improvements.

A unique aspect of the present invention is two bellows that allow liquid cooling of the compressor.

Scroll devices have been used as compressors and vacuum pumps for many years. In general, they have been limited to a single stage of compression due to the complexity of two or more stages. In a single stage, a spiral involute or scroll upon a rotating plate orbits within a fixed spiral or scroll upon a stationery plate. A motor shaft turns a shaft that orbits a scroll eccentrically within a fixed scroll. The eccentric orbit forces a gas through and out of the fixed scroll thus creating a vacuum in a container in communication with the fixed scroll. An expander operates with the same principle only turning the scrolls in reverse. When referring to compressors, it is understood that expander or vacuum pump can be used.

Often oil is used during manufacture and operation of compressors. Oil free or oilless scroll type compressors and vacuum pumps have difficult and expensive manufacturing, due to the high precision of the scroll in each compressor and pump. For oil lubricated equipment, swing links often minimize the leakage from gaps in the scrolls by allowing the scrolls to contact the plate of the scroll. Such links cannot be used in an oil free piece of equipment because of the friction and wear upon the scrolls. If the fixed and orbiting scrolls in oil free equipment lack precision, leakage will occur and the equipment performance will decline as vacuums take longer to induce or do not arise at all.

Prior art designs have previously improved vacuum pumps, particularly the tips of the scrolls. In the preceding work of this inventor, U.S. Pat. No. 6,511,308, a sealant is applied to the scrolls during manufacturing. The pump with the sealant upon the scrolls is then operated which distributes the sealant between the scrolls. The pump is then disassembled to let the sealant cure. After curing the sealant, the pump is reassembled for use.

Then in U.S. Pat. No. 3,802,809 to Vulkliez, a pump, has a scroll orbiting within a fixed scroll. Beneath the fixed disk 13, a bellows 11 guides the gases evacuated from a container. The bellows spans between the involute and the housing, nearly the height of the pump. This pump and many others are cooled by ambient air in the vicinity of the pump.

The present art overcomes the limitations of the prior art where a need exists for bellows in liquid cooling of compressive equipment and improved tip seals upon spirals. That is, the art of the present invention, modifications to scroll compressors utilize two bellows between two scrolls for liquid cooling, an improved tip seal design, and an improved coating method of the spirals.

SUMMARY OF THE INVENTION

Accordingly, the present invention improves scroll compressors and other equipment with bellows suitable for liquid cooling and a plunger actuated seal for the scroll tips. A bellows has a location spanning the fixed and the orbiting scrolls that provides for hermetic sealing of the entire scroll device. Using two bellows, the present invention allows for liquid cooling of a compressor. One bellows serves as an inlet and a second bellows serves as an outlet for coolant from the orbiting and fixed scrolls. Opposite the orbiting scroll, the bellows are in communication to exhaust heat from the coolant to the atmosphere. Then the orbiting scroll has a spiral upon a face. The spiral ends in a tip that passes adjacent to the scroll. To evacuate gases, the tip has a tight fit to the scroll as the tip orbits. The present invention provides a seal upon the tip that abuts the scrolls, a plunger behind the seal, and a spring upon the plunger. The spring and plunger combine to maintain the seal in positive contact with the scrolls.

Additionally, the present invention provides an improved coating upon the fixed scroll or involute. The coating seals the fixed and orbiting scrolls to each other without the use of epoxy. While epoxy seals scrolls, a compressor must run to distribute epoxy and then be cleaned to remove any excess epoxy. The improved coating seals the scrolls upon running the compressor and generates little if any excess coating.

Therefore, it is an object of the present invention to provide new and improved cooling for compressors, vacuum pumps, and expanders.

It is a further object of the present invention to provide hermetic sealing of the orbiting and fixed scrolls.

It is a still further object of the present invention to provide liquid cooling of compressors thus increasing the efficiency of the compressor.

It is an even still further object of the present invention to provide a seal that maintains contact with the opposing scroll as the seal wears during use.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

The same reference numerals refer to the same parts throughout the various figures.

DESCRIPTION OF THE PREFERRED EMBODIMENT

Figure 1:
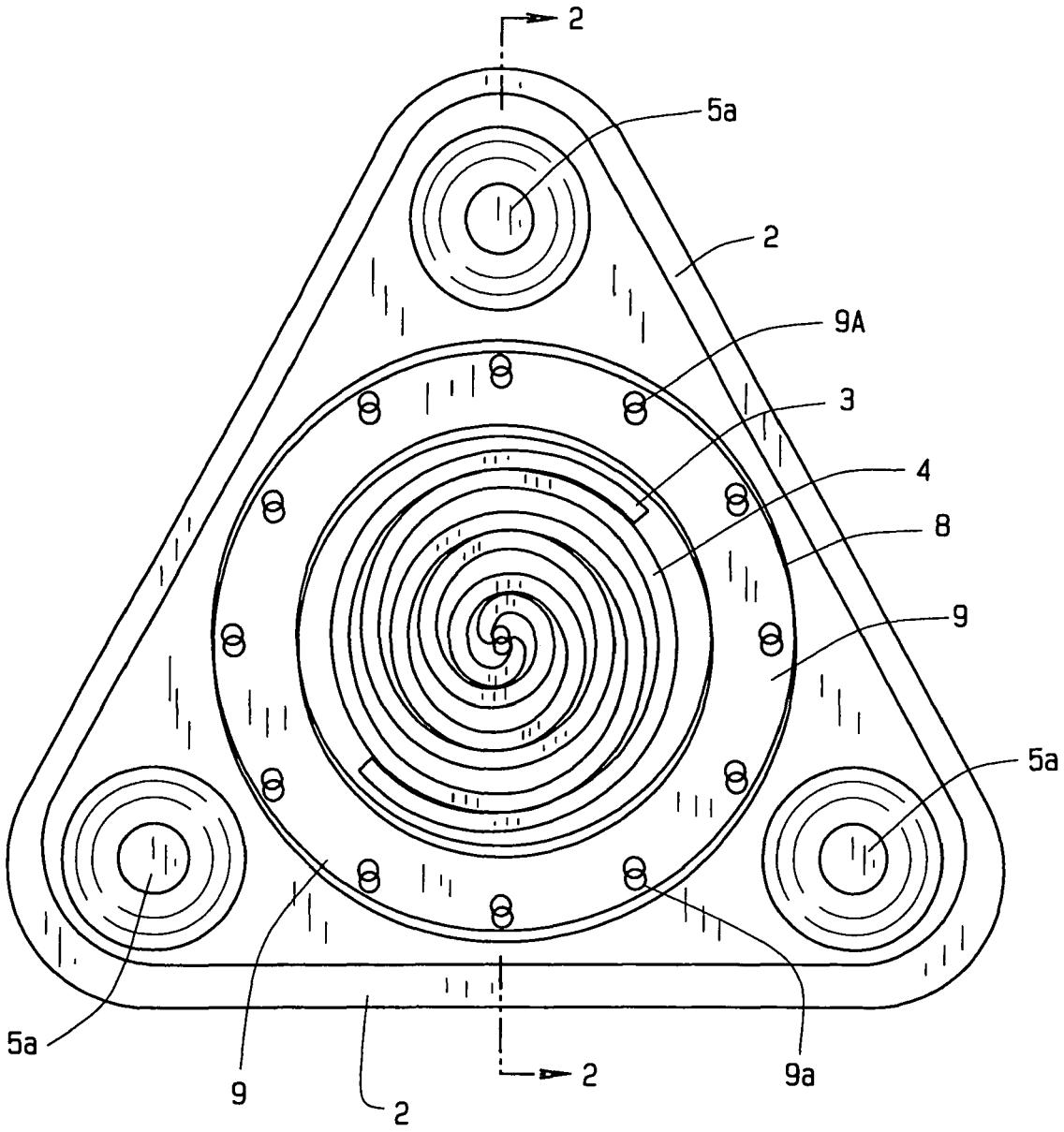
FIG. 1 shows a sectional view through both scrolls of a scroll compressor using the preferred embodiment of the present invention.

The present art overcomes the prior art limitations by modifying scroll compressors and other pumps with bellows, liquid cooling using bellows, and tip seals. Turning to FIG. 1, a scroll compressor 1 appears in a sectional view through the scrolls. The scroll compressor 1 has a case 2 to contain the compressor 1 and scrolls. Within the case 2, the present invention has at least three equally spaced idlers 5*a*. The idlers rotate eccentrically in cooperation with the scrolls as the scrolls compress or evacuate a gas from a container, not shown. The scrolls are located within the idlers and intermesh. The scrolls have a fixed scroll 3 of a generally spiral shape fixed to the compressor 1 and an orbiting scroll 4 also of a generally spiral shape. The orbiting scroll 4 fits within the fixed scroll 3 and as the orbiting scroll 4 turns, gas is drawn into the scrolls and evacuated from the compressor 1. A bellows 8 surrounds and seals the scrolls while remaining flexible. The bellows 8 has two mutually parallel flanges 9, each flange 9 joined to a scroll. The bellows 8 has a hollow round cylindrical shape that extends around the circumference of the scrolls. The bellows 8 can be made of metal, plastic, polymer, or an elastomer among other things. Electro forming, hydro forming, welding, and casting among other means form and shape the bellows 8.

Figure 2:
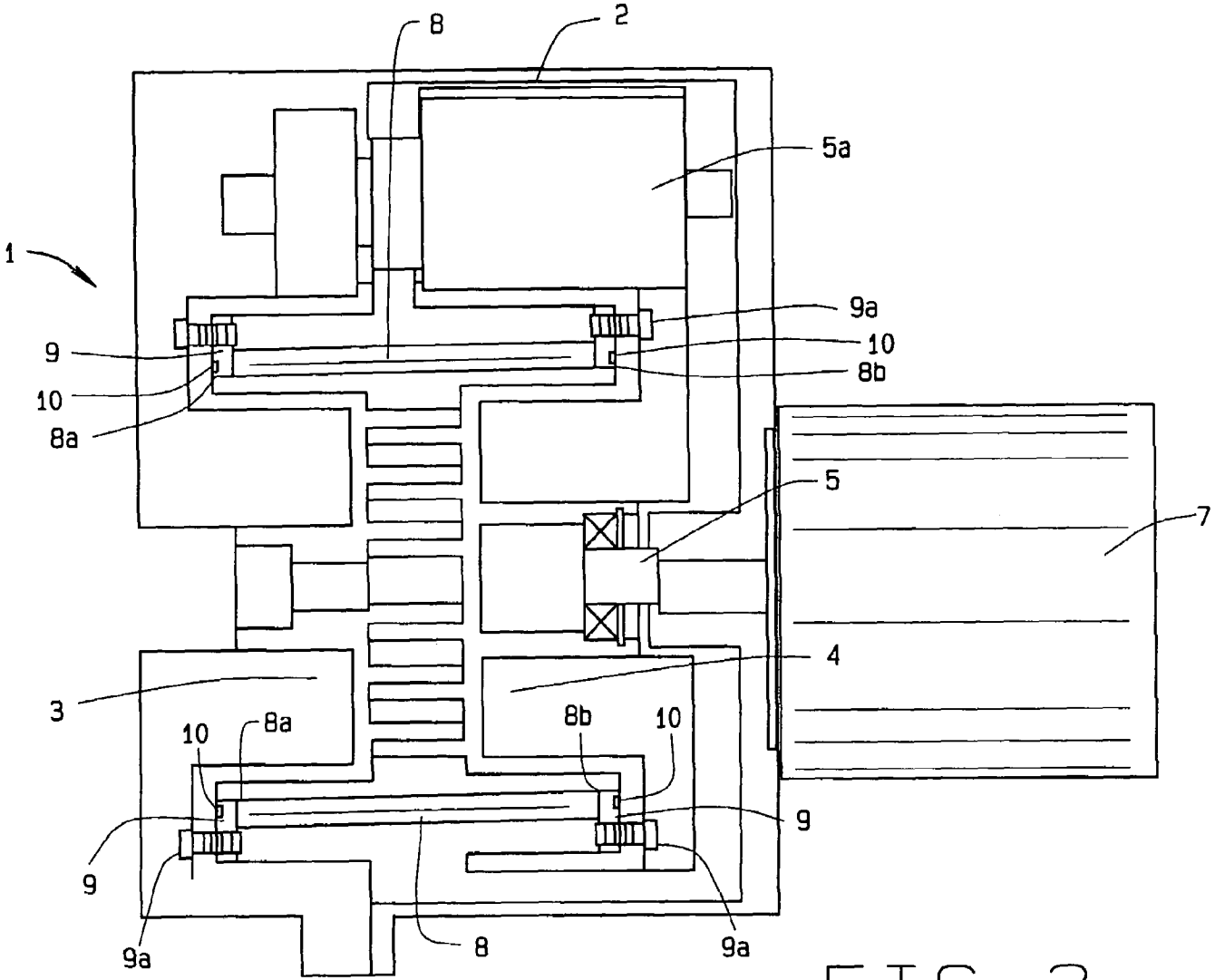
FIG. 2 shows a sectional view through a scroll compressor on a plane through the axis of rotation of the scrolls.

Turning a compressor 1 upon its side, FIG. 2 shows the workings of a compressor 1 in conjunction with a bellows 8. A motor 7 turns an axial shaft which connects with an eccentric shaft 5 that passes through a bearing. The eccentric shaft 5 connects with the orbiting scroll 4. The fixed scroll 3 is opposite the orbiting scroll 4 with an axis coaxial to the eccentric shaft 5. Operation of the motor 7 orbits the orbiting scroll 4 eccentrically which rotates the idlers and their attached counterweights. The idlers 5*a* have an offset shaft to guide the orbiting motion of the orbiting scroll 4. The idlers and counterweights permit eccentric rotation of the orbiting scroll 4 while preventing destruction of the scrolls and the compressors 1 due to centrifugal forces.

Outwards of the scrolls upon the perimeter, an annular well forms within the compressor 1. The well generally extends around the circumference of the scrolls and at least the height of the scrolls outwards from the centerline of the scrolls. Within the annular well, the bellows 8 seals the scrolls. The bellows 8 as before has a generally hollow cylindrical shape with a round flange 9 upon each end. Here in section, the bellows 8 appears on edge as two equally spaced bands. The bellows 8 has a slight inclination to accommodate the eccentric shaft 5. Flanges 9 appear upon each end of the bands and connect the bellows 8 by bolting or other means to the scrolls. The flanges 9 have an annular shape with an inner diameter similar to the inner diameter of the bellows 8. In the preferred embodiment, the flanges 9 bolt to the scrolls. In alternate embodiments, the flanges 9 join the scrolls by welding or brazing. To fully seal the scrolls, the flanges 9 have a sealing ring 10. Here in section, the sealing ring 10 appears as four portions located at the ends of each band. The sealing rings 10 take up any gap between the flanges 9 and the scrolls thus sealing the bellows 8. O-rings or metal seals may serve as the sealing rings 10.

Figure 3:
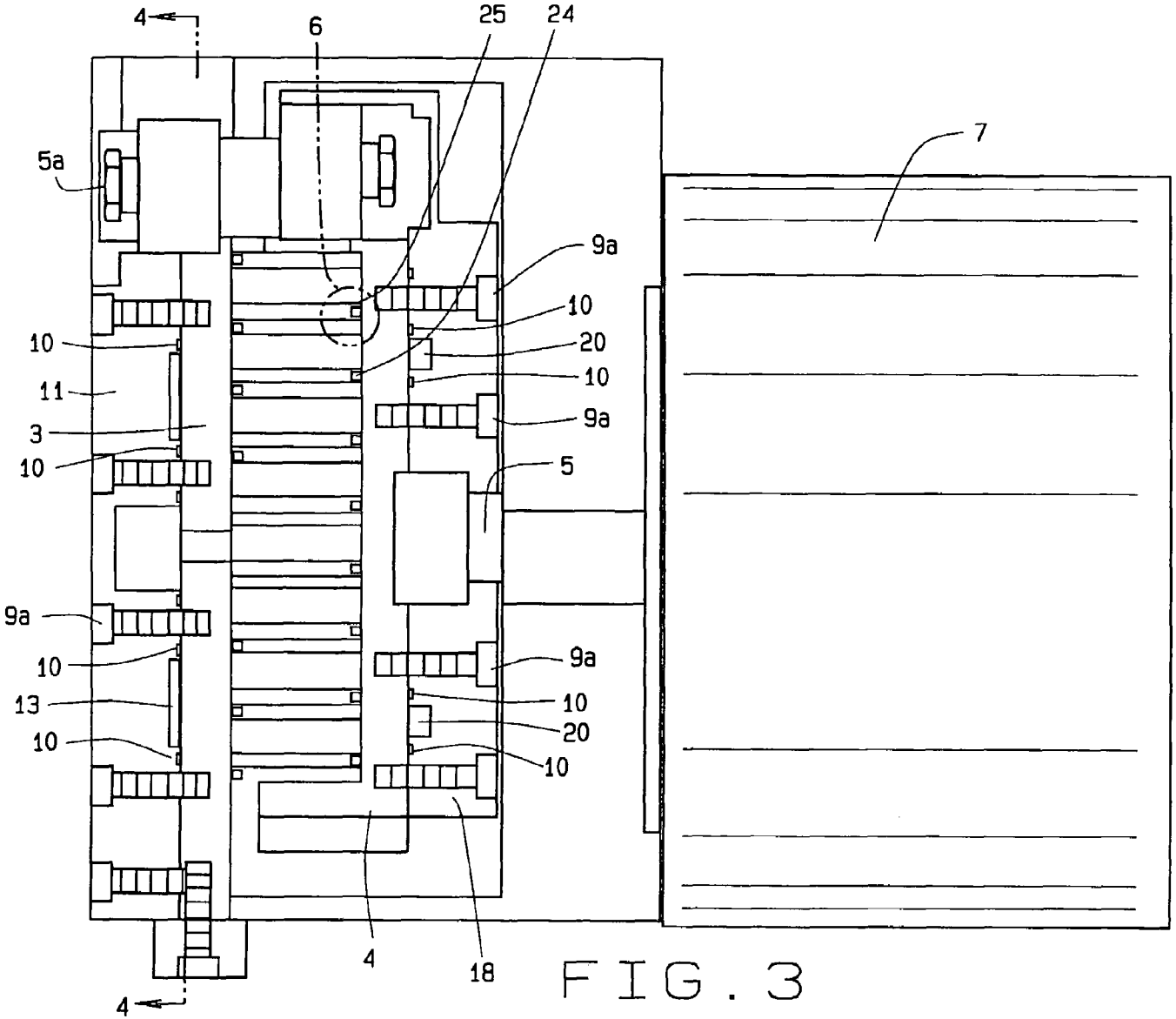
FIG. 3 describes a sectional view through a scroll compressor having liquid cooling.

Liquid cooling of a compressor 1 becomes possible for selected equipment and applications. Liquid cooling proves useful for compressors 1 in confined locations with limited access to air, such as boats or spacecraft. FIG. 3 shows the beginning of a liquid cooled compressor 1. As before, a motor 7 turns a shaft eccentrically connected to the scrolls. The present invention joins an orbiting cooling plate 18 to the orbiting scroll 4 and a fixed cooling plate 11 to the fixed scroll 3. The cooling plates join outwards from the scrolls so evacuation of gases continues unimpeded. The cooling plates have grooves 13, 20 upon their surfaces that form passages when joined against the scrolls. Liquid coolant then circulates through the passages and removes built up heat.

Figure 4:
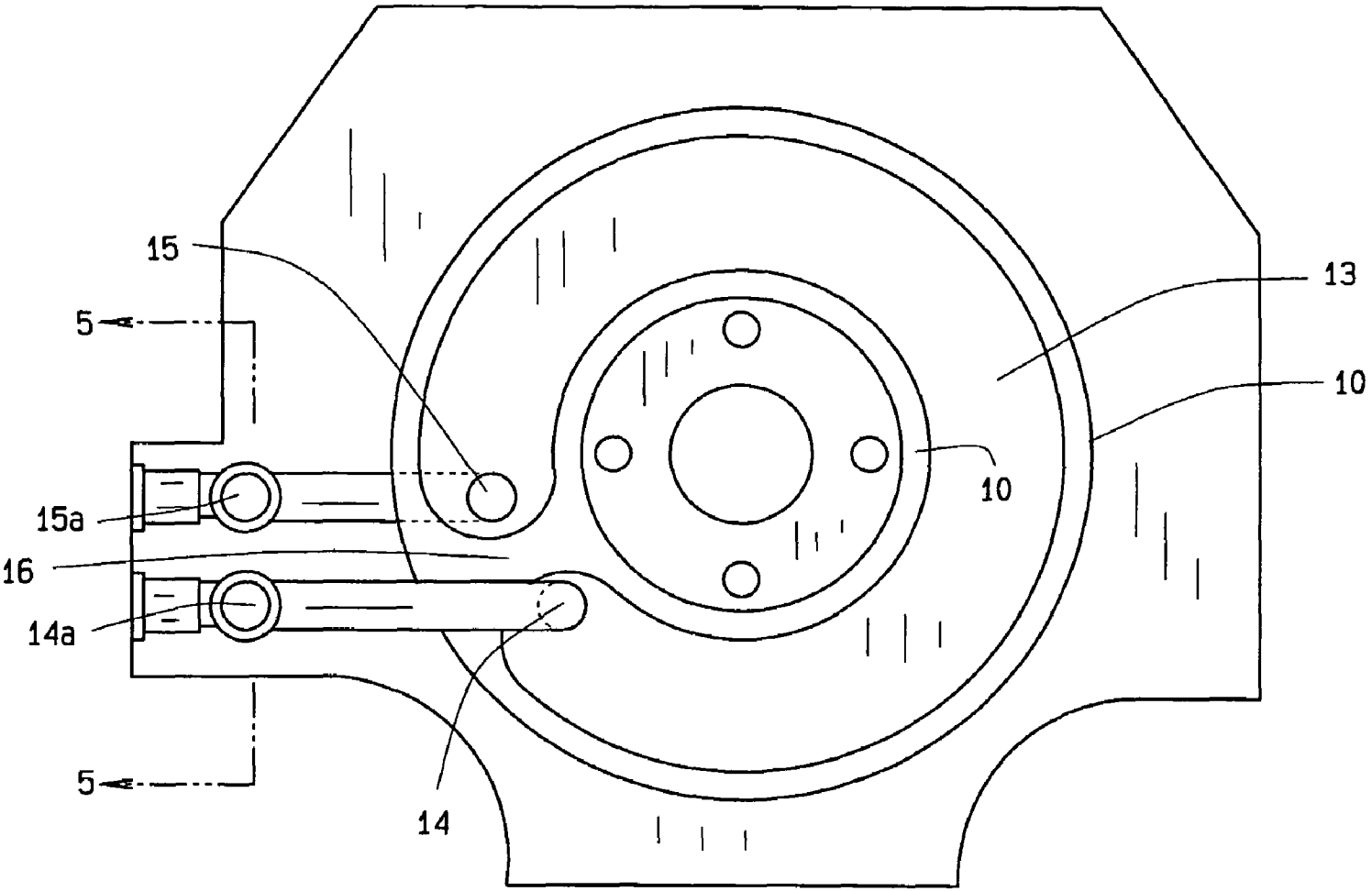
FIG. 4 describes a planar view of the cooling plate and its connection to the bellows of the present invention.

The grooves 13, 20 form a generally annular shape as shown in the sectional view of FIG. 4. The grooves 13 shown are in the fixed cooling plate 11 however the orbiting plate has similar grooves 20. The annular shape of the grooves 13 extends partially around the circumference and partially across the diameter of the fixed cooling plate 11. A wall 16 upon the fixed cooling plate 11 blocks the groove 13 from completely encircling the compressor 1. Proximate to the wall 16, the groove 13 has an aperture 14 in communication with an inlet for liquid coolant and on the other side of the wall 16, an aperture 15 in communication with an outlet to return the coolant for heat exchanging. O-rings 10 seal the inner and outer circumferences of the grooves 13 and apertures 14.

Figure 5:
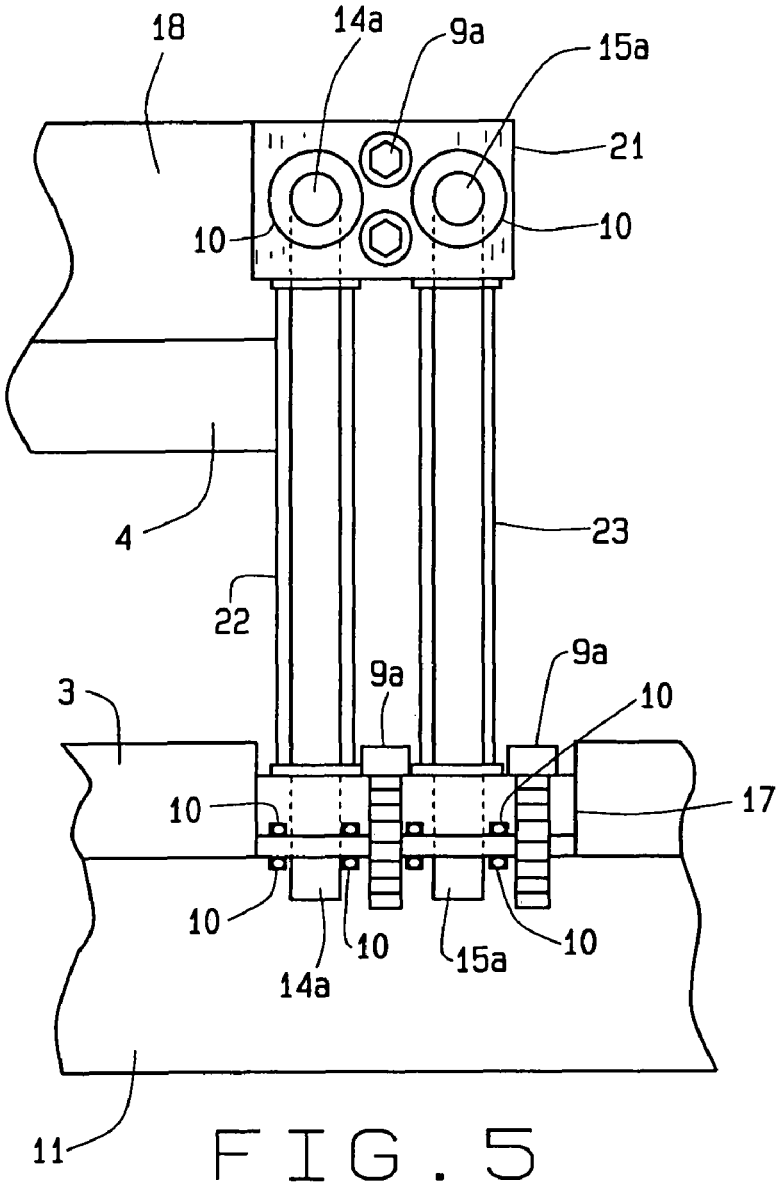
FIG. 5 illustrates a sectional view through the bellows and fittings for liquid cooling of a scroll compressor of the present invention; and, FIG. 6 shows a sectional view through one tip of a scroll having an improved seal of the present invention.

Referencing the inlet and the outlet of FIG. 4, FIG. 5 shows a pair of bellows 22, 23 for conducting liquid coolant into and out of the cooling plates for cooling the compressor 1 during operation. The cooling liquid is pumped into the inlet upon the fixed cooling plate 11, enters an aperture 14, and then travels through the passage 20 to cool the fixed cooling plate 11. A portion of the cooling liquid travels through the first bellows 22 into the inlet aperture 14 upon the orbiting cooling plate 18. The portion of the cooling liquid then enters the passage 20 to cool the orbiting cooling plate 18. The cooling liquid portion then exits the outlet aperture 14 into the second bellows 23. The second bellows 23 also collects cooling liquid from the outlet aperture 14 of the fixed cooling plate 11. The second bellows 23 returns the generally heated cooling liquid from both cooling plates to the outlet for communication to a heat exchanger. The bellows 22, 23 have a hollow cylindrical shape with a flange upon each end sealed to the respective scrolls with sealing rings 10. The flanges join to the bellows by bolting preferably or alternatively by brazing or welding.

Upon the fixed scroll 3, the first bellows 22 and the second bellows 23 join to a first end plate 17. The first end plate 17 has a generally rectangular shape incorporated into the fixed scroll 3 and an upper surface and an opposite lower surface. The first end plate 17 bolts to the fixed scroll 3 in the preferred embodiment with the upper surface towards the orbiting scroll 4. Here the bolts 9*a* are located upon a line through the centers of the first bellows 22 and the second bellows 23. The first and second bellows join to the upper surface of the first end plate 17. Upon the lower surface, O-rings 10 seal fittings for the inlet and outlet of liquid coolant for the compressor 1. The O-rings 10 and fittings have a generally hollow round shape to ease connection of lines carrying the liquid coolant to and from the compressor 1.

Then upon the orbiting scroll 4, the first bellows 22 and the second bellows 23 join a second end plate 21. The second end plate 21 is fastened into the orbiting cooling plate 18, generally perpendicular to the first end plate 17. The second end plate 21 bolts to the orbiting cooling plate 18 with the bolts 9*a* upon the lateral axis of the second end plate 21, generally between the first and second bellows 23. O-rings 10 seal the first bellows 22 and the second bellows 23 to the second end plate 21.

Figure 6:
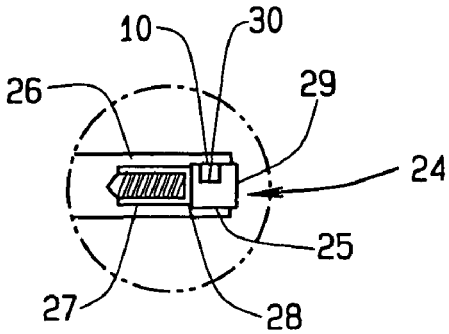

And turning to FIG. 6, the present invention modifies the tips 24 of the fixed scroll 3 and the orbiting scroll 4. Each scroll joins perpendicular to a plate. Opposite the plate, each scroll has a exposed tip 24 in a general spiral pattern. The tip 24 then has a groove 25 open away from the base. The groove

25 extends for the length of the scroll. A plurality of holes 26 is spaced along the length of the spiral. The diameter of each hole 26 is approximately the width of the groove 25. The present invention places into each hole a spring 27 upon a plunger 28, where the spring 27 biases against the plunger 28 outwardly. The plunger 28 has a diameter and shape slightly less than the hole 26. Upon the plunger 28 opposite the spring 27 and towards the tip 24 itself, a seal 29 abuts the opposing scroll. The seal 29 has a complementary shape to the hole 26. In an alternate embodiment, the seal 29 has a secondary O ring seal. The secondary O ring 10 extends in a groove 30 around the circumference of the seal 29. The spring 27 and the secondary O ring 10 prevent leakage between the scrolls as the seals 29 wear during use.

The modifications of the present invention also include a method of sealing the scrolls of a compressor 1. To attain high vacuums and maximum efficiency, imperfections and deviations in the scrolls must be sealed. Previously, epoxy was applied to the surfaces of the scrolls 3, 4, a compressor 1 was assembled and operated for a time, then the scrolls were disassembled and the tip seal grooves 25 cleaned, and then the epoxied scrolls were reassembled into a compressor 1. The present invention applies a mold release or other material upon the tips 24 of the scrolls for filling the tip seal groove 25, assembles the scrolls together, injects epoxy into the scrolls, then operates the compressor 1 for a time to disperse the epoxy. The mold release inhibits the adhesion and accumulation of epoxy upon the tips 24 thus reducing the need to disassemble, to clean, and then to reassemble the compressor 1. In the present invention, the epoxy occupies any gaps between the adjacent scroll's plate. The method of the present invention may eliminate the need for a tip seal 29 as previously described. In the preferred embodiment of this method, the mold release is a lubricating fluid. In an alternate embodiment, this method uses a mold release selected from elastomers, gels, greases, low hardness plastics, and pliable sealants. The method of the present invention applies to scroll compressors, vacuum pumps, and expanders alike.

From the aforementioned description, modifications to a scroll compressor have been described. The modifications of the present invention are uniquely capable of sealing the fixed and orbiting scrolls of the compressor, providing liquid cooling, and sealing the tips of the scrolls. The modifications of the present invention and its various components adapt existing equipment and may be manufactured from many materials including but not limited to metal sheets and foils, elastomers, steel plates, polymers, high density polyethylene, polypropylene, polyvinyl chloride, nylon, ferrous and nonferrous metals, their alloys, and composites.

I claim:

1. A device for altering the pressure within a container having a fixed scroll enmeshed with an orbiting scroll, said orbiting scroll driven by an eccentric shaft, said eccentric shaft driven by a motor, a coolant, and a case containing said fixed scroll and said orbiting scroll further comprising:

a fixed cooling plate attaching behind said fixed scroll and having a central hole and a partially annular groove, said groove forming a passage between said fixed cooling plate and said fixed scroll, said groove having at least one aperture separated by a wall for transmitting coolant into, through, and out of said passage;

a first end plate perpendicular to said fixed scroll and coplanar with said fixed scroll, having two adjacent apertures with one bolt between said apertures, said apertures in communication with said inlet and said outlet;

an orbiting cooling plate attaching behind said orbiting scroll and having a central hole and a partially annular groove, said groove forming a passage between said orbiting cooling plate and said orbiting scroll, said groove having at least one aperture separated by a wall for transmitting coolant into, through, and out of, said passage;

a second end plate perpendicular to said orbiting cooling plate and to said first end plate, having two adjacent apertures with two bolts between said apertures, said apertures in communication with said inlet and said outlet;

a first bellows connecting the left apertures of said first end plate and said second end plate having sealing rings at both ends of said first bellows; and, a second bellows connecting the right apertures of said first end plate and said second end plate having sealing rings at both ends of said second bellows;

whereby coolant enters said inlet into said fixed cooling plate and said first bellows into said inlet of said orbiting cooling plate, travels through said passages in said fixed cooling plate and said orbiting cooling plate, returns through said outlet of said orbiting cooling plate into said second bellows and said outlet of said fixed cooling plate for exchange of heat outside said device.

2. The pressure altering device of claim 1 further comprising:

said groove extending from one aperture partially around said fixed cooling plate and terminating at another aperture, and having said wall span across the width of said groove;

whereby coolant attains a one way flow through said passage.

3. The pressure altering device of claim 1 further comprising:

said first bellows and said second bellows each having a hollow cylindrical shape and two opposing open ends, a flange upon each of said ends, and a sealing ring upon each of said flanges opposite said respective ends;

each of said flanges attaching to said first end plate and said second end plate respectively; and each of said sealing rings sealing each of said flanges to said first end plate and said second end plate respectively;

whereby said first bellows and said second bellows endures the oscillations of said orbiting scroll within a minimum of leakage from said orbiting scroll and said fixed scroll.

4. The pressure altering device of claim 1 further comprising:

said flanges having an annular shape with an inner diameter similar to the inner diameter of said bellows and an outer diameter similar to the outer diameter of said bellows.

5. The pressure altering device of claim 4 wherein said flanges are attached to said first end plate and said second end plate respectively by one of bolting, welding, or brazing.

* * * * *